United States Patent [19]

Mezger et al.

[11] Patent Number: 4,527,517

[45] Date of Patent: Jul. 9, 1985

[54] WATER PUMP FOR RECIPROCATING PISTON INTERNAL COMBUSTION ENGINE

[75] Inventors: Hans Mezger, Freiberg; Reinhard Könneker, Monsheim; Joachim Kelm, Pforzheim, all of Fed. Rep. of Germany

[73] Assignee: Harley-Davidson Motor Co., Inc., Milwaukee, Wis.

[21] Appl. No.: 630,775

[22] Filed: Jul. 13, 1984

[30] Foreign Application Priority Data

Jul. 21, 1983 [DE] Fed. Rep. of Germany ..... 3326318

[51] Int. Cl.[3] ..... F01P 5/12

[52] U.S. Cl. ..... 123/41.47

[58] Field of Search ..... 123/41.44, 41.46, 41.47, 123/198 C

[56] References Cited

U.S. PATENT DOCUMENTS

| | | | |
|---|---|---|---|
| 3,603,296 | 9/1971 | Mitchell | 123/41.46 |
| 4,155,333 | 5/1979 | Maggiorana | 123/41.44 |
| 4,467,747 | 8/1984 | Braate et al. | 123/41.46 |

FOREIGN PATENT DOCUMENTS

| | | | |
|---|---|---|---|
| 57-183514 | 11/1982 | Japan | 123/41.72 |

OTHER PUBLICATIONS

Automobile Engineer, Aug. 1970, pp. 320–321.

*Primary Examiner*—William A. Cuchlinski, Jr.

[57] ABSTRACT

A water pump for a reciprocating piston internal combustion engine is driven by a shaft located between the camshaft and crankshaft. The intermediate shaft which is driven by and coupled to the crankshaft at one wall of the crank housing. The water pump is located in a remote wall of the crank housing, which itself forms one half of the pump containment. A dish-shaped housing half screws into the remote wall to contain the pump. The intermediate shaft is connected to the pump wheel of the water pump by a hollow shaft which passes longitudinally through the crank housing. Together with the bearings, securing elements, sealing rings and a bearing flange, the shaft forms a structural unit which may be pre-assembled and easily inserted into the engine.

5 Claims, 1 Drawing Figure

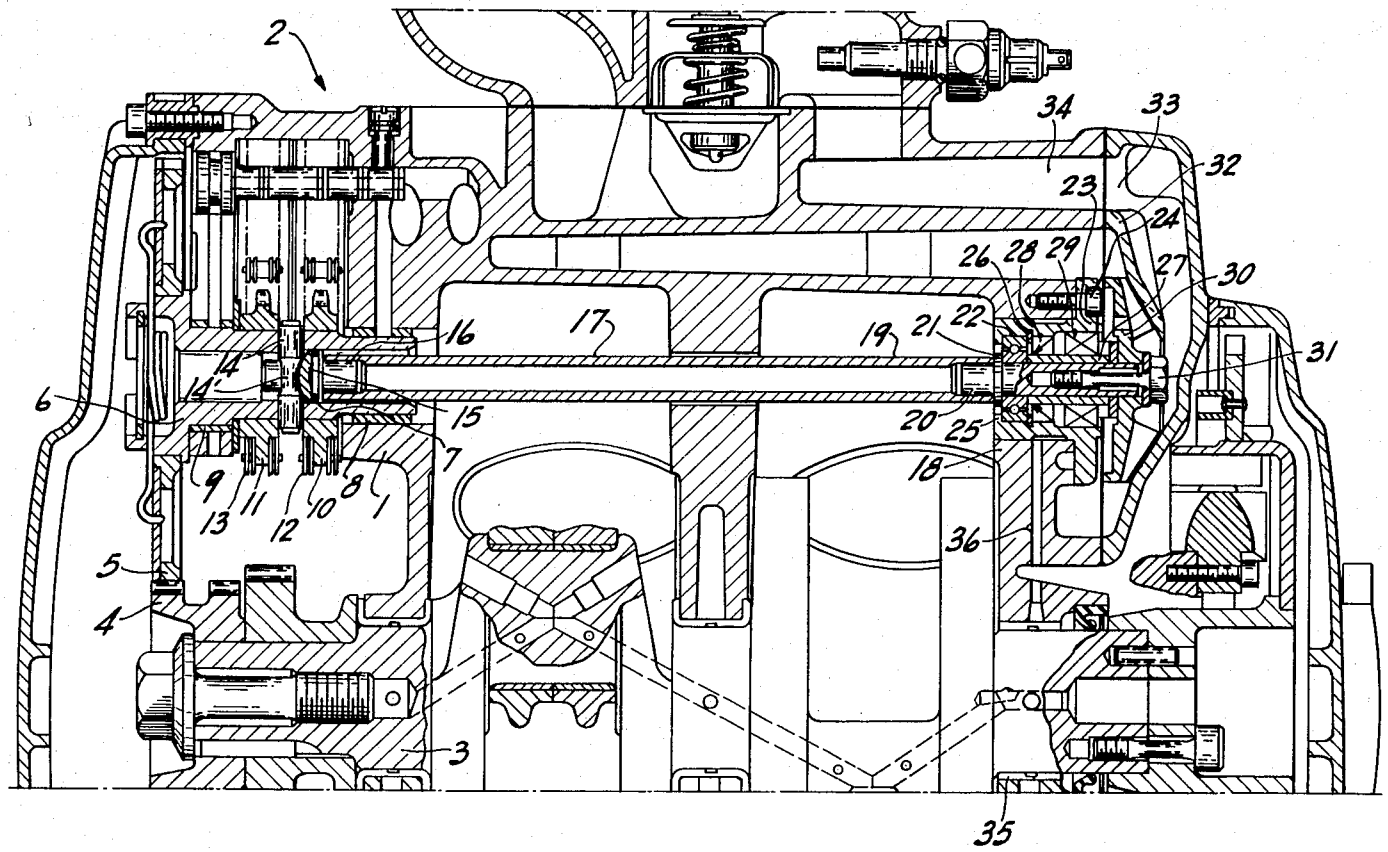
2
3
4
5
6
7
8
9
10
11
12
13
14
15
16
17
18
19
20
21
22
23
24
25
26
27
28
29
30
31
32
33
34
35
36

WATER PUMP FOR RECIPROCATING PISTON INTERNAL COMBUSTION ENGINE

BACKGROUND OF THE INVENTION

1. Field of the Invention

The present invention relates generally to the field of water pumps for reciprocating piston internal combustion engines and more particularly to a water pump drive using an intermediate shaft driven by the crankshaft and mounted on one end wall of the crank housing.

2. Description of the Prior Art

In the German Offenlegungsschrift No. 24 37 946, the drive cogwheels of the camshaft are located on one wall of the crank housing. The water pump is attached on the other side of the crank housing and is driven directly by the camshaft. The pump wheel is coaxially fixed on the camshaft by means of a central screw and is mounted in a two-part housing, which is screwed to the outside of the crank housing. Although this construction uses few components, it has the disadvantage that it requires additional structural space in the longitudinal direction of the internal combustion engine. Furthermore, the pump wheel always operates at the camshaft speed, as a result of which strict limits are imposed on the structural form of the water pump. Such limits relate to the additionally specified values of feed pressure and feed volume.

OBJECTS AND SUMMARY OF THE INVENTION

It is a primary object of the present invention to provide an arrangement for a water pump in which the pump does not enlarge the outer contour of the internal combustion engine.

A further object of the invention is to provide a water pump for an internal combustion engine, the speed of which may be set independently of the speed of the crankshaft.

A different object of the invention is to provide a water pump for an internal combustion engine wherein the pump housing is formed partly by a wall of the crank housing and partly by a dish-shaped housing half which is screwed onto the crank housing.

Another object of the invention is to provide a water pump for an internal combustion engine which includes improved drive and bearing components.

Yet another object of the present invention is to provide a water pump for an internal combustion engine which may be readily assembled and disassembled.

How these and other objects of the invention are accomplished will be described by reference to the following description of the preferred embodiment, taken in conjunction with the drawings. Generally, however, they are accomplished by mounting the water pump in a recess of the crank housing wall above the crankshaft flywheel, thus integrating the pump into the contour of the engine. One half of the pump housing is formed by a wall of the crank housing and the other half is formed by a dish-shaped housing half which is screwed into such wall. The pump is driven by a shaft intermediate the camshaft and crankshaft to provide the speed selectively. Assembly and disassembly is facilitated by employing a hollow drive shaft which forms a pre-assembled structural unit with the bearing and gaskets. To insert the unit, the hollow shaft is passed through the end wall of the crank housing and a forkhead on the forward end engages a pin of the intermediate shaft. The intermediate shaft then drives the hollow shaft and the pump wheel mounted thereto.

DESCRIPTION OF THE FIGURE

The FIGURE is a cross section of an internal combustion engine crank housing showing the water pump and drive system of the present invention.

DESCRIPTION OF THE PREFERRED EMBODIMENT

A crank housing 2 of an internal combustion engine is shown in FIG. 1.

On the outer side of one end wall 1 of the crank housing 2, a cogwheel 4 is secured on the crankshaft 3. Cogwheel 4 meshes with a cogwheel 5 of a parallel intermediate shaft 6. The intermediate shaft 6 is drilled hollow and is mounted in bearing bushes 8 and 9 of the end wall 1. The camshaft (not shown) located above shaft 6 is driven by means of a sprocket fixed on the intermediate shaft 6. The sprocket has toothed rims 10 and 11 and roller chains 12 and 13.

A pin 14 is inserted transversely into the intermediate shaft 6 between the sprocket rims 10 and 11, and the central recess 14' of the pin engages a forkhead 15, which in turn is pressed into the end 16 of a hollow shaft 17. The forkhead 15 is held resiliently and without play in the hollow shaft 17 by means of an O-ring 7.

The hollow shaft 17 extends parallel to the crankshaft along the crank housing and is used to drive a water pump (soon to be described) which is disposed on the other end wall 18 of the crank housing 2. To accomplish such attachment, a stud 20 is pressed into the other end 19 of the hollow shaft 17 until it comes to rest against a collar 21. The stud 20 is mounted in a ball bearing 22, which is centered in a bearing flange 23. Flange 23 is centered in the end wall 18 and is flanged on its outer side and attached by screws 24.

The outer ring of the ball bearing 22 is held in place by an attachment 25 of the bearing flange 23 and an expanding ring 26. The inner ring of the ball bearing 22 is held in place by the collar 21 of the stud 20 and by a sleeve 27 centered thereon. On the sleeve 27 there are two sealing rings 28 and 29, which are fitted in the bearing flange 23.

On the outer end of stud 20, a pump wheel 30 is centered and in secured by means of a centrally aligned bolt 31. The bolt 31 also insures that the sleeve 27 is clamped against the inner ring of the ball bearing 22.

A dish-shaped, other housing half 32 is screwed into the outer surface of wall 18, the latter forming one housing half of the water pump. The arrangement is such that with the interposition of a gasket, the water duct 33 opens into the water duct 34 of the crank housing 2 in a congruent manner.

Since the ball bearing 22 and the sealing rings 28 and 29 are located perpendicularly above the crankshaft bearing 35, they may be supplied with lubricant from the latter through a perpendicular bore 36.

To assemble the water pump of the present invention, the forkhead 15 is first pressed into the first end 16 of the hollow shaft 17 and the stud 20 is pressed into the other end 19 until it comes to rest against the collar 21. The ball bearing 22 and the sleeve 27 are then inserted onto the stud 20. Then the hollow shaft with the ball bearing 22 disposed thereon is fitted into the bearing flange 23. The outer ring of the ball bearing 22 is secured by fitting the explanding ring 26. Between sleeve 27 and the bearing flange 23 sealing rings 28 and 29 are inserted.

This structural unit, assembled outside the internal combustion engine, is inserted into the crank housing 2 as a compact plug-in unit until the forkhead 15 engages the recess 14' of the pin 14 and until the bearing flange 23 comes to rest against the outer side of the end wall 18, to which it is subsequently attached by screws 24. Finally, the pump wheel 30 is bolted onto the stud 20, and the dish-shaped housing half 32 is screwed onto the end wall 18.

While the present invention has been described by reference to a particular illustrated embodiment, the invention is not to be limited by such description, but only by the claims which follow.

We claim:

1. A water pump apparatus of a reciprocating piston internal combustion engine, said engine including a crank shaft housing having first and second end walls and a camshaft driven by a crankshaft mounted on said first end wall, shaft means intermediate said crankshaft and said camshaft and drivingly connected to said crankshaft, water pump means having a pump wheel mounted adjacent to but outwardly of said second end wall, housing means surrounding said water pump means, said housing means forming one portion of the containment of said water pump means, said second end wall forming the remaining portion of said containment, further shaft means coupling said intermediate shaft means and said water pump means, said further shaft means being a hollow shaft, a first end of which is coupled to said intermediate shaft and the second end of which is mounted through said end wall and is connected to said pump wheel of said water pump means, and, stud means inserted in said second end of said hollow shaft means, said stud means passing through said second wall, said pump wheel being centered and secured to the end of said stud means outwardly of said second wall.

2. The invention set forth in claim 1 further comprising bearing means around said stud means, a sleeve on said stud means intermediate said bearing means and said pump wheel, and two sealing ring means mounted about said sleeve intermediate said bearing means and said pump wheel.

3. The invention set forth in claim 2 wherein a bearing flange contains said bearing means and said sealing ring means and when coupled to said hollow shaft forms a structural unit, which may be pre-assembled and inserted into the crankshaft housing.

4. A water pump apparatus of a reciprocating piston internal combustion engine, said engine including a crank shaft housing having first and second end walls and a camshaft driven by a crankshaft mounted on said first end wall, shaft means intermediate said crankshaft and said camshaft and drivingly connected to said crankshaft, water pump means having a pump wheel mounted adjacent to but outwardly of said second end wall, housing means surrounding said water pump means, said housing means forming one portion of the containment of said water pump means, said second end wall forming the remaining portion of said containment, further shaft means coupling said intermediate shaft means and said water pump means, said further shaft means being a hollow shaft and wherein said first end of said hollow shaft is a forkhead, pin means passing transversely through said intermediate shaft means.

5. The invention set forth in claim 4 wherein said intermediate shaft includes an annular groove and wherein an O-ring surrounding said hollow shaft is contained within said groove and resiliently holds said forkhead in said intermediate shaft.

* * * * *